United States Patent [19]

Guckenheimer

[11] Patent Number: 4,500,758

[45] Date of Patent: Feb. 19, 1985

[54] KEYBOARD SWITCH ASSEMBLY HAVING SENSORY FEEDBACK

[75] Inventor: Peter U. Guckenheimer, Campbell, Calif.

[73] Assignee: Hewlett-Packard Company, Palo Alto, Calif.

[21] Appl. No.: 510,526

[22] Filed: Jul. 5, 1983

[51] Int. Cl.[3] ..... H01H 13/70; H01H 9/00

[52] U.S. Cl. ..... 200/5 A; 200/DIG. 1; 361/288

[58] Field of Search ..... 200/5 A, 159 B, 5 R, 200/DIG. 1; 361/288, 290

[56] References Cited

U.S. PATENT DOCUMENTS

Re. 30,435 11/1980 Fukao ..... 361/288 X 4,117,279 9/1978 Schoemer ..... 200/5 A 4,375,585 3/1983 Lee ..... 200/5 A

*Primary Examiner*—J. R. Scott

*Attorney, Agent, or Firm*—Jeffery B. Fromm; Cheryl L. Shavers

[57] ABSTRACT

A keyboard switch assembly is disclosed which utilizes a new switch design for providing tactile feedback to the user while nevertheless permitting long switch life. The keyboard switch assembly provides adjustable touch control to the user via a mechanical adjustment means while requiring minimal key travel. The "sandwich" arrangement of the dome and the membrane switch isolates the contacts from contamination upon activation resulting in long switch life. Furthermore, integration of all the parts in the assembly of this keyboard switch makes this keyboard more competitive and cost effective.

14 Claims, 6 Drawing Figures

KEYBOARD SWITCH ASSEMBLY HAVING SENSORY FEEDBACK

BACKGROUND OF THE INVENTION

This invention relates to a new and improved keyboard switch design having an improved means for tactile feedback.

Some keyboards have provided tactile feedback to the user. However, tactile feedback which is adjustable and has the added benefit of touch control feedback is not easy to achieve and still provide long switch life. In addition, some of these keyboards use a switch assembly which is often complicated, requiring numerous parts and a complex assembly procedure.

SUMMARY OF THE INVENTION

The present invention discloses a keyboard switch assembly having a switch array for providing a switch output signal in response to key depression. As part of this keyboard switch assembly there is provided a layer of resilient and flexible material having deformable domes.

In the preferred embodiment, the domes provide a tactile feedback signal to the user. This tactile feedback signal or feel enables the user to determine by touch whether or not electrical contact has been made.

As another feature of this invention, touch control is obtained by adding a series of inclined surfaces or ramps to the bottom surface of the switch mounting plate and top surface of the mating switch housing in the switch array. The series of inclined surfaces or rams on the switch mounting plate and the switch housing work together to allow the total switch array to be raised or lowered. This operation establishes a pretravel condition for the flexible domes thereby altering the amount of key travel required by user to make contact to a underlying contactor and thereby altering the tactile feel of the keyboard switches.

DESCRIPTION OF THE PREFERRED EMBODIMENT

Figure 1:
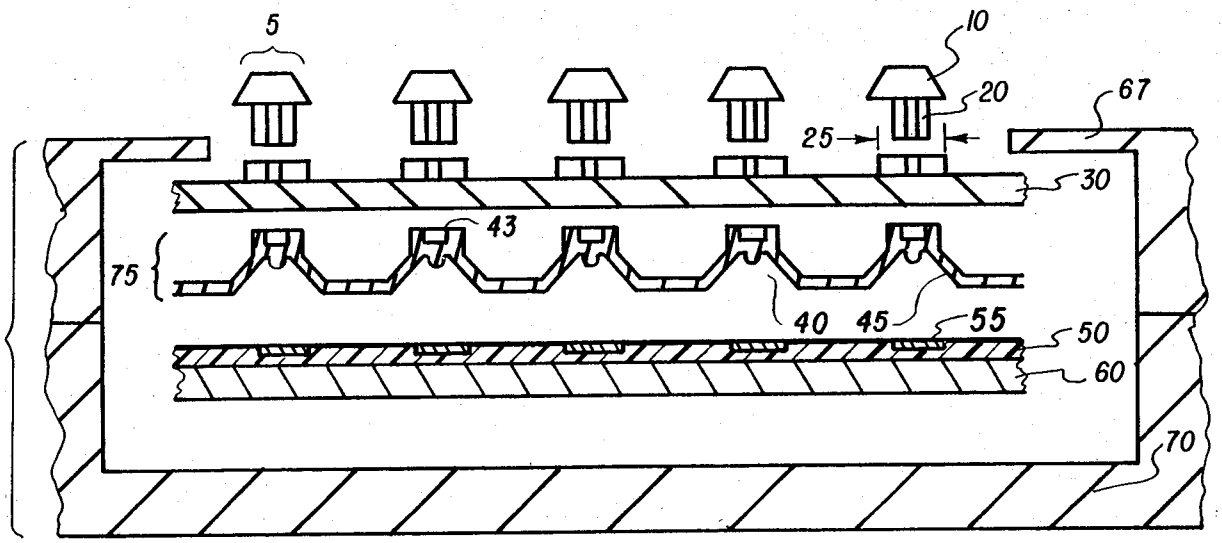
FIG. 1 is an exploded view of a keyboard switch assembly incorporating the teachings of the present invention.

FIG. 1 shows a section through a series of push button switches 5 forming a keyboard assembly. Each switch 5 is a single "make" contact switch in which depression of a suitably profiled resilient dome 40 activates a membrane switch contact 50 and activable switch area 55. A series of switches 5 are contained by switch housing 70 and bezel 67. The switch contact 50 along with the resilient domes 40 can form for example, either a capacitance-type or resistance-type switch, in which the flexible layer 50 is flexed in order to produce a large change in capacitance or resistance, respectively.

Key cap 10 is attached to key plunger 20 which is then positioned through opening 25. Upon depression of key cap 10, plunger 20 is carried through key mount 30 thereby making contact with a portion 43 of the dome 40 which in turn activates the membrane switch contact 50. Membrane switch contact 50 and activable switch area 55 are axially and concentrically mounted below plunger 20 on switch mounting plate 60 or in the alternative membrane switch contact 50 and activable switch area 55 can be directly mounted on switch housing 70 thereby eliminating the need for switch mounting plate 60. When adequate pressure is applied to key cap 10, portion 43 of dome 40 will move relative to the contact switch 50 to provide the desired electrical signal.

Figure 2:
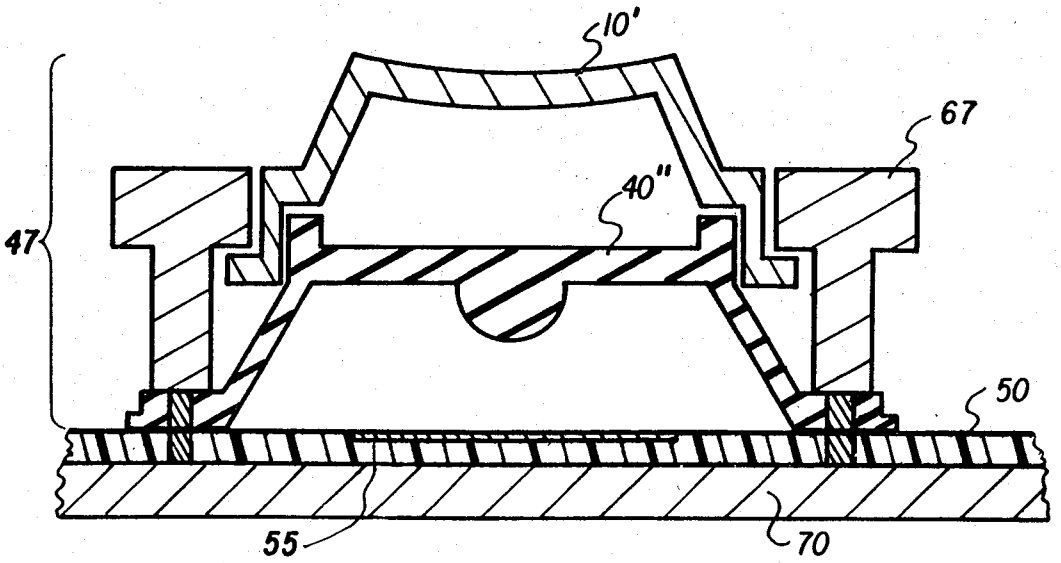
FIG. 2 is a cross-sectional view of a portion of the keyboard of FIG. 1, showing another embodiment of the present invention.

The domes 40 are formed as a molded network with all the domes on one sheet 75. A nonconductive resilient flexible material such as a silicone elastomer is used for sheet 75 to provide both smooth operation of switches 5 as well as a spring for the keycaps 10. Molding or forming the domes 40 as a single sheet 75 also simplifies assembly of the total keyboard. As shown in FIG. 2, it is also possible to mold or form the key caps 10' and domes 40'' as a single piece 47 thereby eliminating plunger 20 and key mount 30.

A capacitance-type membrane switch contact 50 is well know in the art as described in greater detail in U.S. Pat. Nos. 4,367,385, 4,373,122 and 4,373,124 and can be commercially obtained from the W. H. Brady Company of Milwaukee, Wis., and is composed of a thin, plastic (e.g. mylar and copper) sandwich. In addition, electrical components can be soldered directly to the mylar membrane 50 to eliminate the need of a separate printed circuit board and thus providing a complete switch assembly in a single strip.

Figure 3:
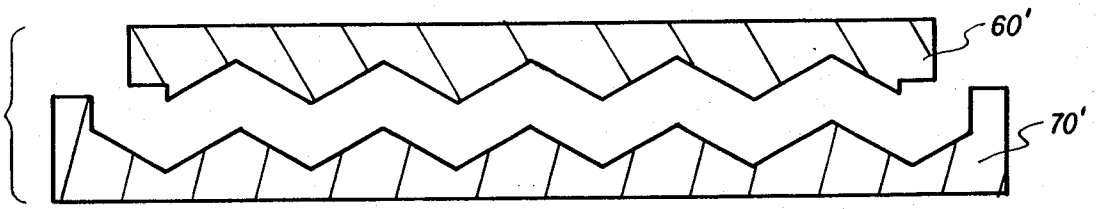
FIG. 3 is a cross-sectional view of a portion of the keyboard of FIG. 1, showing another embodiment of the present invention.
Figure 4:
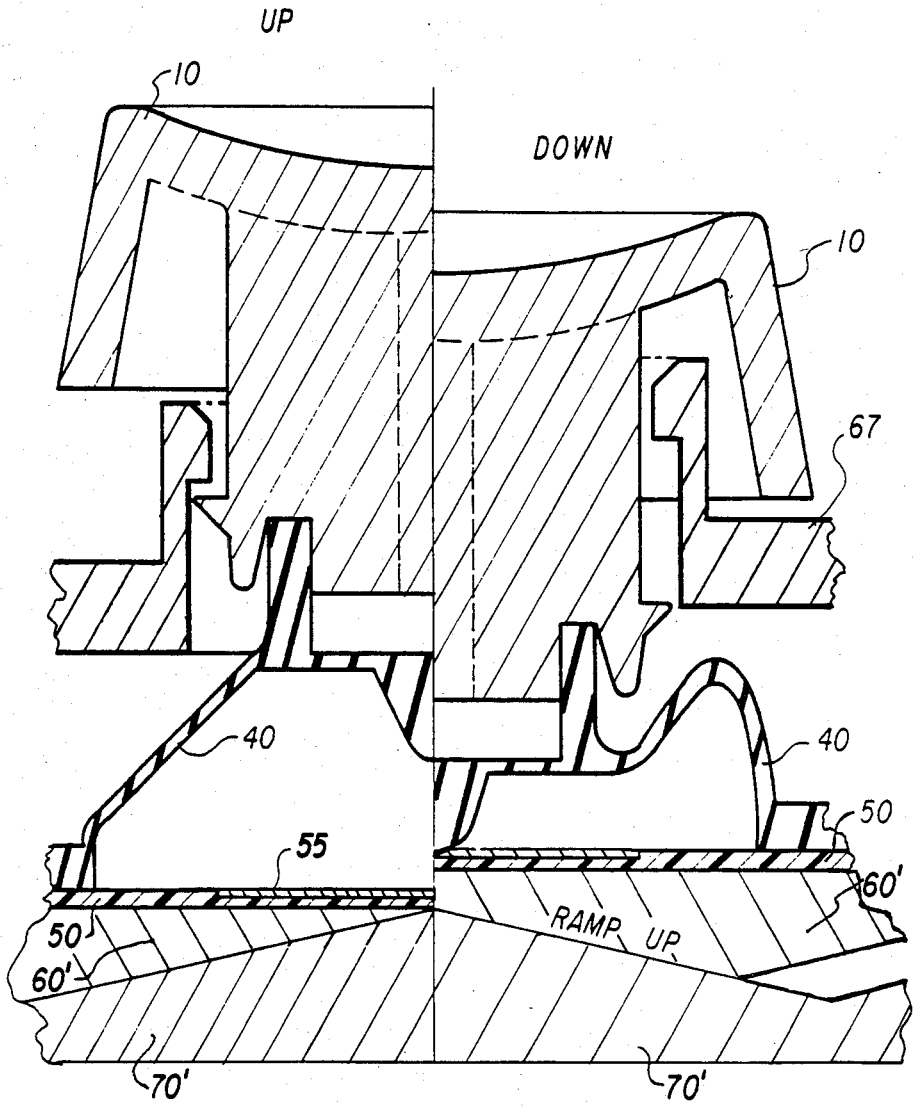
FIG. 4 is a cross-sectional view of a portion of the keyboard of FIG. 1, showing the switch array thereof in a preloaded condition.

FIG. 3 illustrates a further embodiment of the present invention. Touch control of the force required to depress the key caps 10 is obtained by mounting or forming a series of inclined surfaces or ramps on the bottom surface of the switch mounting plate 60' and the mating top surface of switch housing 70'. The switch housing 70' can in combination with switch mounting plate 60' provide a preload condition on the switch array 5 which includes dome 40, membrane switch contact 50 and switch mounting plate 60'. By moving the switch array 5 up or down relative to the switch housing 70', as shown in FIG. 4, a pretravel condition for the domes 40 is established so that less or more key travel is required by the user to make contact to the membrane switch contact 50. Furthermore, movement of the switch array 5, up or down relative to the switch housing 70' provides adjustment of the spring force created by the domes 40 against key caps 10. Adjusting the preload on the key caps 10 provides uniform spring force on key caps 10 and is done all at one time.

Figure 5A:
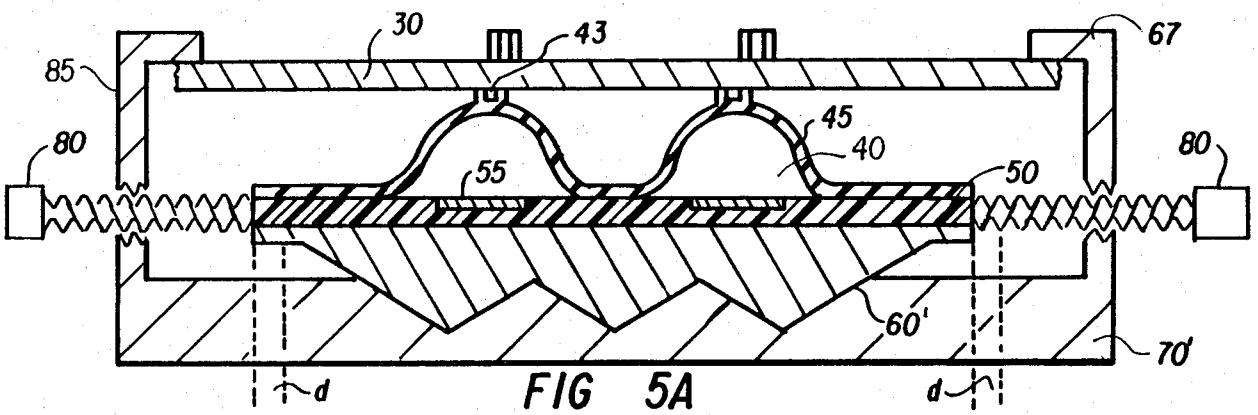
FIG. 5A is a cross-sectional view of a portion of the keyboard of FIG. 1, showing the switch array thereof.
Figure 5B:
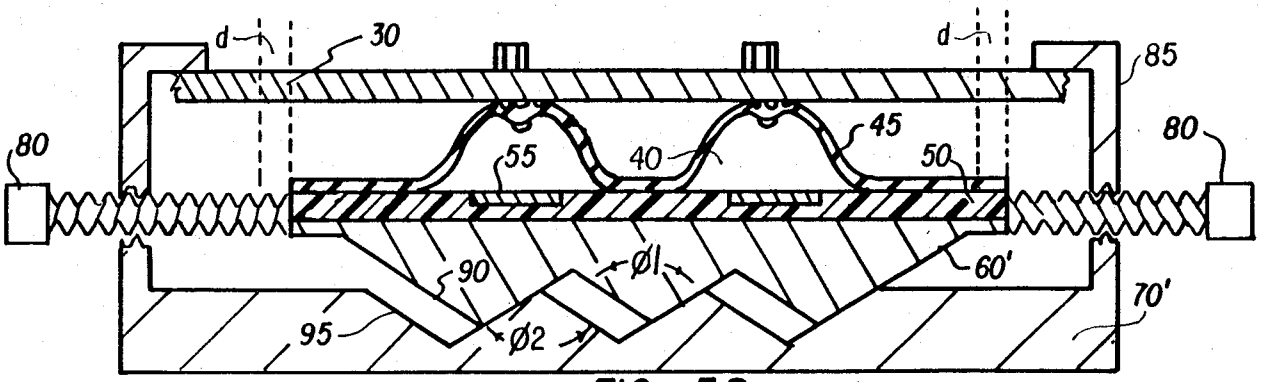
FIG. 5B is a cross-sectional view of the switch array of FIG. 5A, shown in a pretravel adjustment condition.

FIGS. 5A and 5B show that as adjustment screws 80 threaded through the sidewalls 85 of switch housing 70' are turned lateral movement of the switch mounting plate 60' occurs across a dimension d and the inclined surface 90 of the switch mounting plate 60' rides along the corresponding inclined surface 95 of the switch housing portion 70' in a vertical direction. This movement causes the simultaneous raising or lowering of the switch mounting plate 60' in relation to the switch mounting portion 70' resulting in compression of portion 45 of dome 40 since portion 43 of dome 40 is held fixed in a plane by key mount 30 as previously shown in FIG. 1 and further illustrated in FIGS. 5A and 5B. The compression of dome 40 adjusts the spring force of the dome thereby setting a preload condition for touch control for the user. Typically, the inclined surfaces 90 and 95 will be formed as sawtooths when viewed in cross section with equal side angles 1 and 2 respectively.

Furthermore, the single dome network sheet 75 coupled with the sawtooth structures of switch housing 70 and switch mounting plate 60 makes it possible for the first time to adjust the key touch uniformily and all at one time for a plurality of keys.

I claim:

1. A switch apparatus comprising:

membrane means having an activable switch area for providing a switch output signal in response to activation of said switch area by a predetermined stimulus;

dome means directly coupled to said membrane means, said dome means having a resiliently deformable dome-like portion having a spring force, said dome-like portion positioned in proximity to said activable switch area, said dome means for providing said predetermined stimulus to said activable switch area in response to deformation of said dome-like portion; and adjustment means coupled to act directly on said membrane means, said adjustment means having:

a base having an inclined bottom surface;

a housing coupled to said base having an inclined upper surface for mating with said inclined bottom surface;

a displacement means coupled to said housing and said base for causing relative movement between said housing and said base; and a keymount affixed to said housing, said adjustment means for deforming said dome-like portion against said keymount, thereby adjusting the spring force of said dome-like portion.

2. A switch apparatus as in claim 1 wherein said dome means comprises a plurality of resiliently deformable dome-like portions formed in a single layer.

3. A switch apparatus as in claim 1 wherein no D.C. current can flow between said resiliently deformable dome-like portion and said switch area upon activation of said switch area.

4. A switch apparatus as in claim 1 wherein said resiliently deformable dome-like portion is positioned substantially in line with said activable switch area.

5. A switch apparatus as in claim 1 wherein said membrane means comprises a capacitive switch.

6. A switch apparatus as in claim 1 wherein at least a portion of said inclined bottom surface comprises a first ramp-like pattern.

7. A switch apparatus as in claim 6 wherein said first ramp-like pattern comprises a plurality of surfaces connected to form a first sawtooth surface.

8. A switch apparatus as in claim 1 wherein said inclined upper surface comprises a second ramp-like pattern in cooperation with said inclined bottom surface.

9. A switch apparatus as in claim 8 wherein said second ramp-like pattern comprises a plurality of surfaces connected to form a second sawtooth surface.

10. An switch apparatus as in claim 1 wherein said bottom surface comprises a first ramp-like pattern having a plurality of surfaces connected to form a first sawtooth surface;

said upper surface comprises a second ramp-like pattern having a plurality of surfaces connected to form a second sawtooth surface; and said first and second sawtooths surface have substantially equal inside angles.

11. An switch apparatus as in claim 1 wherein said housing has threaded apertures extending therethrough and said displacement means comprises adjustment screws extending through the threaded apertures to bear against opposite sides of said base to move said base laterally with respect to said housing.

12. A switch apparatus as in claim 1 further comprising a plurality of resiliently deformable dome-like portions, said resiliently deformable dome-like portions being coupled to a plurality of keys for providing a spring force against said keys.

13. A switch apparatus as in claim 12 wherein said adjustment means is coupled to said keymount for adjusting the amount of said spring force on said plurality of keys all at one time.

14. A switch apparatus as in claim 13 wherein said amount of spring force is adjusted uniformly so that the tactile feel of said plurality of keys to a user is substantially uniform.

* * * * *

UNITED STATES PATENT AND TRADEMARK OFFICE

CERTIFICATE OF CORRECTION

PATENT NO. : 4,500,758

DATED : February 19, 1985

INVENTOR(S) : Peter U. Guckenheimer

It is certified that error appears in the above—identified patent and that said Letters Patent is hereby corrected as shown below:

Column 1, line 32, "rams" should read --ramps--

Signed and Sealed this

*Twentieth* Day of *August 1985*

[SEAL]

*Attest:*

DONALD J. QUIGG

*Attesting Officer* *Acting Commissioner of Patents and Trademarks*